US008419385B2

(12) United States Patent
Horng

(10) Patent No.: US 8,419,385 B2
(45) Date of Patent: Apr. 16, 2013

(54) HEAT-DISSIPATING FAN

(75) Inventor: Alex Horng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 770 days.

(21) Appl. No.: 12/484,375

(22) Filed: Jun. 15, 2009

(65) Prior Publication Data

US 2010/0316508 A1 Dec. 16, 2010

(51) Int. Cl.
*F04B 35/04* (2006.01)
*H02K 21/12* (2006.01)
*H02K 1/22* (2006.01)

(52) U.S. Cl.
USPC ..... 417/353; 417/423.7; 417/423.14; 310/156.32; 310/268; 310/71

(58) Field of Classification Search ..... 417/352, 417/353, 354, 423.7, 423.14, 424.1, 424.2; 310/156.32, 156.37, 268, 71, 67 R, DIG. 6; 361/695, 679.48
See application file for complete search history.

(56) References Cited

U.S. PATENT DOCUMENTS 6,027,307 A * 2/2000 Cho et al. ..... 415/173.5
6,544,011 B2 4/2003 Hsieh
6,710,486 B1 3/2004 Horng et al.
6,998,751 B2 * 2/2006 Lopatinsky et al. ..... 310/208
7,038,913 B2 5/2006 Lee et al.
7,099,157 B2 * 8/2006 Boer et al. ..... 361/721
7,134,839 B2 11/2006 Horng et al.
7,237,599 B2 * 7/2007 Lopatinsky et al. ..... 165/80.3
7,291,956 B2 * 11/2007 Itoh et al. ..... 310/208
2005/0106046 A1 * 5/2005 Winkler ..... 417/423.3
2006/0045773 A1 * 3/2006 Ku et al. ..... 417/423.7
2007/0176508 A1 * 8/2007 Kasai et al. ..... 310/156.32
2007/0280840 A1 * 12/2007 Sugiyama et al. ..... 417/423.5

FOREIGN PATENT DOCUMENTS

TW M291024 5/2006

* cited by examiner

*Primary Examiner* — Devon Kramer
*Assistant Examiner* — Bryan Lettman
(74) *Attorney, Agent, or Firm* — Alan Kamrath; Kamrath IP Lawfirm, P.A.

(57) ABSTRACT

A heat-dissipating fan includes a shaft seat. A coil base is coupled to the shaft seat. The coil base includes a base portion and a coil unit coupled to the base portion. The base portion includes a connection port electrically connected to the coil unit. The connection port is connected to a drive circuit. An impeller includes a hub and a permanent magnet. A shaft is coupled to the hub and rotatably coupled to the shaft seat about an axis. The permanent magnet is coupled to the hub and aligned with the coil unit. Since the coil base does not include electronic elements of the drive circuit, the axial height of the heat-dissipating fan is reduced, and the structure of the heat-dissipating fan is simplified.

11 Claims, 10 Drawing Sheets

HEAT-DISSIPATING FAN

BACKGROUND OF THE INVENTION

1. Field of the Invention

The present invention relates to a heat-dissipating fan and, more particularly, to a heat-dissipating fan with a reduced axial height and with a reduced volume.

2. Description of the Related Art

Miniaturization is the trend of electronic products. Currently available heat-dissipating fans generally include a housing, a stator and an impeller. The stator includes a stator core, a coil unit, and a circuit board. The stator comprised of the stator core, the coil unit, and the circuit board limits reduction in the overall axial height of the heat-dissipating fans. As a result, it is difficult to achieve a light, compact design of the heat-dissipating fans and, thus, it is difficult to mount the heat-dissipating fans in miniature electronic devices or equipment.

Efforts have been made in reducing the axial height of the heat-dissipating fans by reducing the axial height and volume of the stator. However, the results are not satisfactory. FIG. 1 shows a conventional heat-dissipating fan 80 including a housing 81, a control unit 82, a stator 83, and an impeller 84. The housing 81 includes a fixed seat 811 and a shaft tube 812. The control unit 82 includes a control circuit board 821 mounted on a face of the fixed seat 811. The stator 83 is mounted around the shaft tube 812 and electrically connected to the control circuit board 821. The impeller 84 is rotatably mounted to the shaft tube 812. The axial height of the heat-dissipating fan 80 can be reduced by mounting the circuit board 821 of the control unit 82 on the face of the fixed seat 811. Such a heat-dissipating fan is disclosed in Taiwan Utility Model No. M291024. However, the drive circuit on the control circuit board 821 still has a certain height in the axial direction. Furthermore, the structure of the housing 81 is complicated, for the housing 81 must include the fixed seat 811 for mounting the control circuit board 821. Further, the stator 83 still includes a stator core and other components that prevent further reduction in the axial height. Overall, the effect in reduction of the axial height is limited.

FIGS. 2 and 3 show a conventional heat-dissipating fan 90 including a housing 91 having a compartment 911 in which a base 912 is formed. A circuit board 92 and a coil unit 93 are mounted on the base 912. A shaft tube 913 is formed on a center of the base 912. A rotor 94 is rotatably coupled to the shaft tube 913 and rotatably received in the compartment 911. By omitting components including a stator core, the axial height of the heat-dissipating fan 90 can be reduced. However, the drive circuit on the control circuit board 92 still has certain heights in the axial direction, causing limitation to further reduction in the overall axial height of the heat-dissipating fan 90 when the circuit board 92 is mounted on the base 912. Furthermore, the coil unit 93 protrudes beyond the face of the circuit board 92, such that the coil unit 93 and the circuit board 92 still have certain axial heights in the axial direction. As a result, it is difficult to achieve a light, compact design of the heat-dissipating fan 90 and, thus, it is difficult to mount the heat-dissipating fan 90 in miniature electronic devices or equipment.

Thus, a need exists for a heat-dissipating fan with a reduced axial height and with a reduced volume to meet the design trend of compactness and miniaturization.

SUMMARY OF THE INVENTION

The present invention solves this need and other problems in the field of miniaturization of heat-dissipating fans by providing, in a first aspect, a heat-dissipating fan including a shaft seat. A coil base is coupled to the shaft seat. The coil base includes a base portion and a coil unit coupled to the base portion. The base portion includes a connection port electrically connected to the coil unit. An impeller includes a hub and a permanent magnet. A shaft is coupled to the hub and rotatably coupled to the shaft seat about an axis. The permanent magnet is coupled to the hub and aligned with the coil unit. The connection port can be electrically connected to a drive circuit by a connection wire. Since the coil base does not include electronic elements of the drive circuit, the axial height of the heat-dissipating fan is reduced, and the structure of the heat-dissipating fan is simplified.

In a preferred form, the shaft seat includes a fixed portion and a coupling portion formed on a side of the fixed portion. The shaft is rotatably coupled to the coupling portion. The base portion includes an outer layer formed on a face of the base portion. The coil unit is formed on a side of the outer layer, and the coil unit is intermediate the outer layer and the fixed portion of the shaft seat along the axis. The axial height of the heat-dissipating fan can be further reduced.

In preferred forms, the base portion of the coil base includes first and second faces spaced along the axis. An outer layer is formed on the first face. A bottom layer is formed on the second face, and the coil unit is intermediate the first and second faces along the axis. The axial height of the heat-dissipating fan can be further reduced.

In a preferred form, the impeller further includes an annular wall formed around the hub. An air inlet and an air outlet are formed between the annular wall and the hub. Air currents driven by the impeller can, thus, be guided through a simple structure.

In another preferred form, a housing includes a compartment, and a mounting portion is provided in the compartment. The shaft seat is coupled to the mounting portion. The housing includes an air inlet and an air outlet. The air inlet and the air outlet are in communication with the compartment. Air currents driven by the impeller can, thus, be guided through a simple structure.

In a further preferred form, a housing includes a compartment having a peripheral wall. The base portion is mounted in the compartment and interconnected to the peripheral wall of the compartment by a plurality of connecting members. The housing further includes an air inlet and an air outlet. The air inlet and the air outlet are in communication with the compartment. Air currents driven by the impeller can, thus, be guided. Furthermore, the air driving effect can be enhanced while having a simplified structure by omitting the mounting portion.

In preferred forms, the housing further includes a slot in communication with the compartment. A positioning member is mounted in the slot. The positioning member presses against and, thus, positions the connection wire electrically connected between the connection port and the drive circuit.

In a preferred form, the connection port of the coil base is electrically connected to a drive circuit board. The drive circuit board includes a drive circuit and a plurality of electrical connections electrically connected to the drive circuit. The axial height of the coil base can be reduced.

In a second aspect according to the teachings of the present invention, a heat-dissipating fan includes a shaft seat. A coil base is coupled to the shaft seat. The coil base includes a base portion and a coil unit coupled to the base portion. The base portion includes a connection port electrically connected to the coil unit. The connection port is electrically connected to an end of a connection wire. An impeller includes a hub and a permanent magnet. A shaft is coupled to the hub and rotatably coupled to the shaft seat about an axis. A permanent magnet is coupled to the hub and aligned with the coil unit. An air gap is formed between the permanent magnet and the coil unit. A drive circuit is electrically connected to another end of the connection wire. The drive circuit is outside of the air gap.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
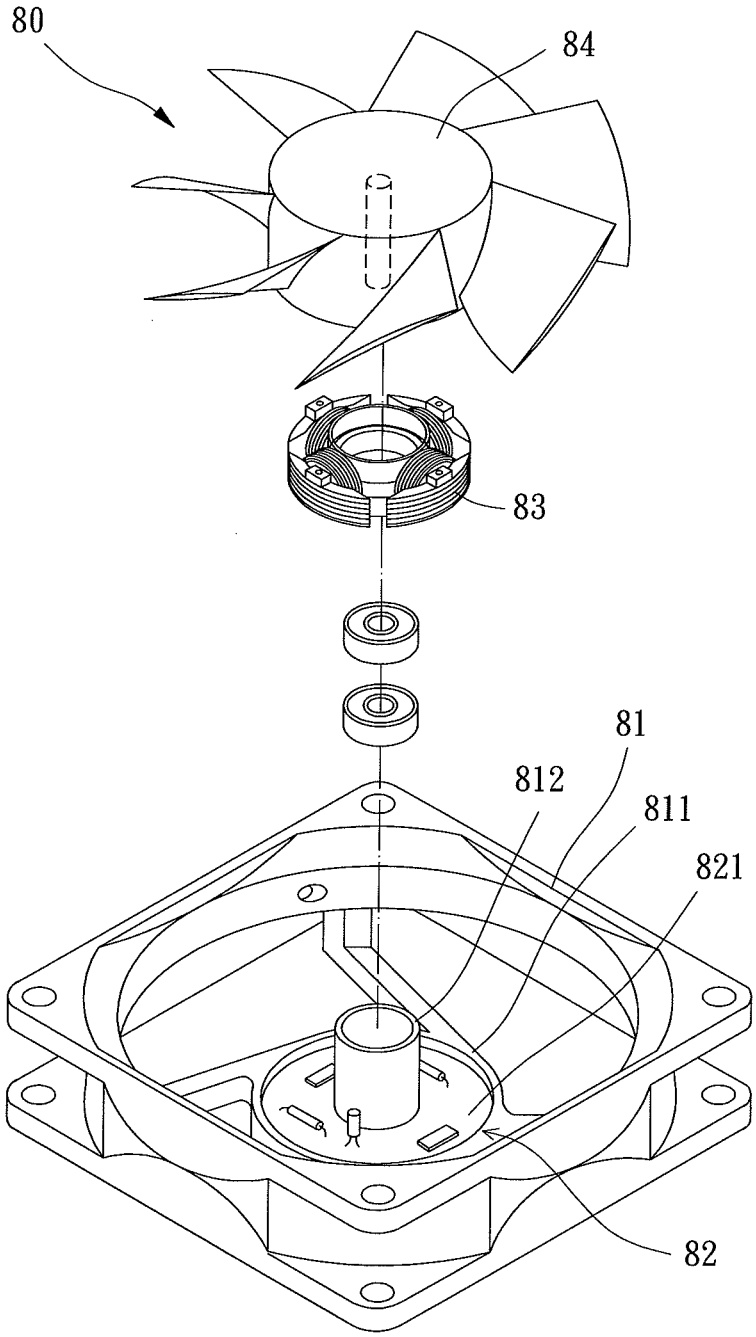
FIG. 1 PRIOR ART
FIG. 1 shows an exploded, perspective view of a conventional heat-dissipating fan.
Figure 2:
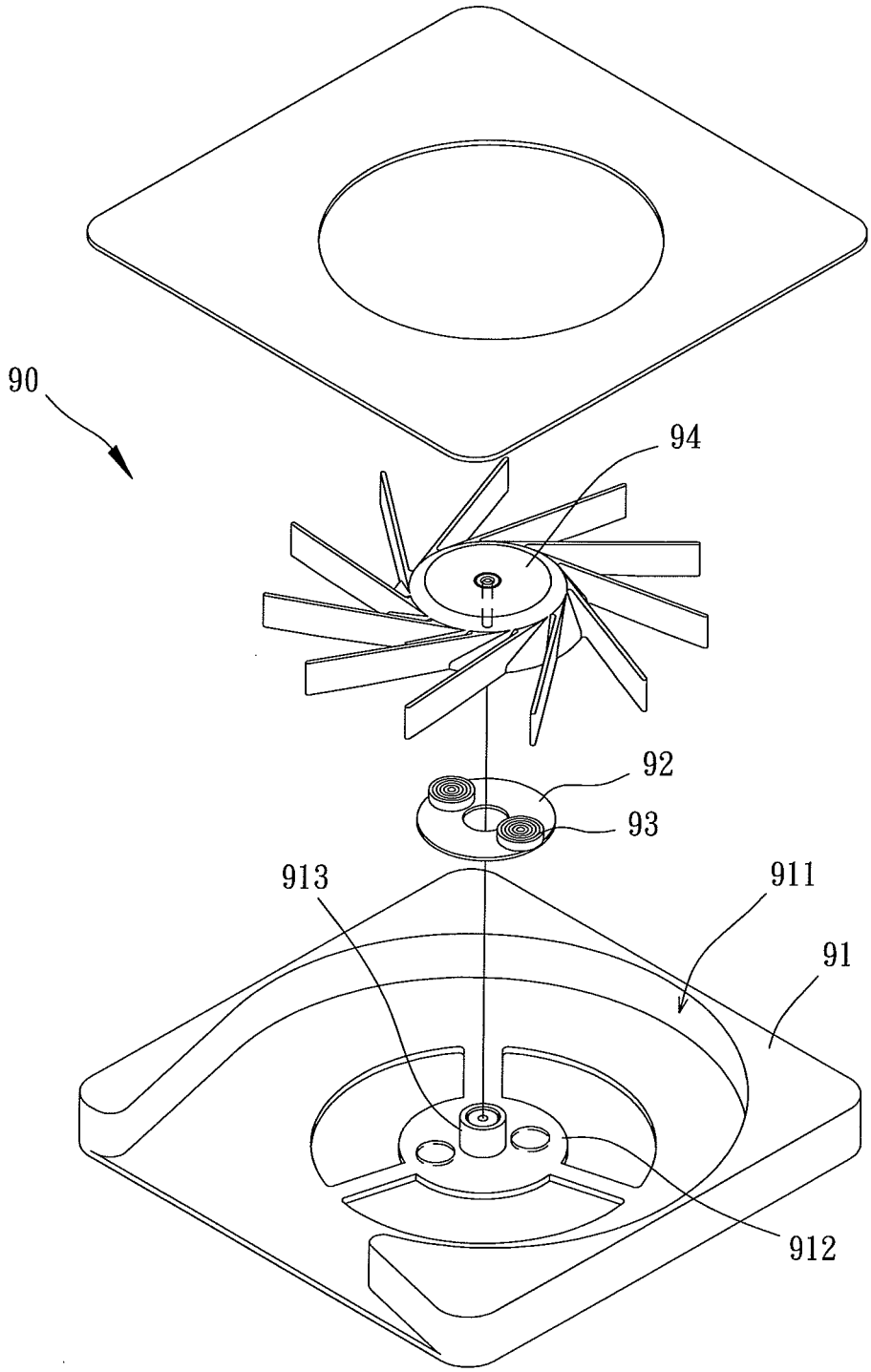
FIG. 2 PRIOR ART
FIG. 2 shows an exploded, perspective view of another conventional heat-dissipating fan.
Figure 3:
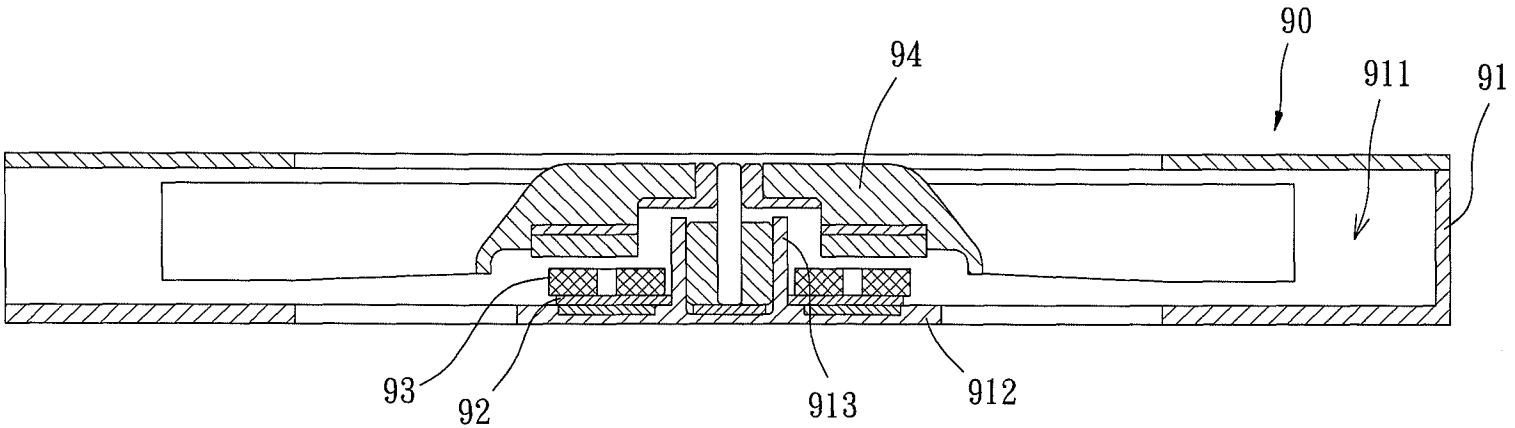
FIG. 3 PRIOR ART
FIG. 3 shows a cross sectional view of the miniature fan of FIG. 2.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "portion", "end", "outer", "annular", "radial", "axial", "outward", "height", "width", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A heat-dissipating fan according to the preferred teachings of the present invention is shown in FIGS. 4-10 of the drawings. In the preferred form shown in FIGS. 4-9, the heat-dissipating fan includes a shaft seat 10, a coil base 20, and an impeller 30. The shaft seat 10 includes a fixed portion 11 and a coupling portion 12 formed on a side of the fixed portion 11. The fixed portion 11 can be directly coupled in a desired location of any electronic device or equipment or of an object requiring dissipation of heat.

In the preferred form shown in FIGS. 4-9, the coil base 20 includes a base portion 21 and a coil unit 22. The base portion 21 is preferably a printed circuit board and has opposite first and second faces spaced along an axis. The coil unit 22 can be formed by layout or other suitable provisions to be integrally formed with the base portion 21. Preferably, the coil unit 22 does not protrude beyond the first and second faces of the base portion 21, to effectively reduce an axial height of the coil base 20 along the axis. The base portion 21 includes a connection port 23 electrically connected to the coil unit 22. The connection port 23 is directly formed on the base portion 21 in the preferred forms shown in FIGS. 4 and 5. In the preferred form shown in FIGS. 6 and 7, the base portion 21 includes an extension extending radially outward from an outer periphery of the base portion 21, and the connection port 23 is formed on the extension.

In the preferred form shown in FIGS. 4-9, the coil base 20 further includes an outer layer 211 and a bottom layer 212. The outer and bottom layers 211 and 212 are preferably of electrical insulation, with the outer layer 211 provided on the first face of the base portion 21 as an electrically insulating layer and the bottom layer 212 provided on the second face of the base portion 21 as another electrically insulating layer. Thus, the coil base 20 is electrically insulated by the outer and bottom layers 211 and 212. The bottom layer 212 is in contact with the fixed portion 11 of the shaft seat 10. The coil unit 22 is between the outer layer 211 and the bottom layer 212 along the axis. In a case that the coil base 20 does not include the bottom layer 212, the coil unit 22 is between the outer layer 211 and the fixed portion 11 along the axis.

In the preferred form shown in FIGS. 4-9, the impeller 30 includes a hub 31 and a permanent magnet 32. A shaft 311 is coupled to the hub 31 and rotatably coupled to the coupling portion 12 about the axis. The permanent magnet 32 is coupled to the hub 31 and aligned with the coil unit 22. An air gap 36 is formed between the permanent magnet 32 and the coil unit 22 along the axis.

In the preferred forms shown in FIGS. 4-9, the connection port 23 allows electrical connection to a drive circuit 40. Specifically, an end of a connection wire 50 is electrically connected to the connection port 23, and the other end of the connection wire 50 is electrically connected to the drive circuit 40. By such an arrangement, the drive circuit 40 can be indirectly connected to the coil unit 22 via the connection port 23 for activating the coil unit 22, which causes interaction between the coil unit 22 and the permanent magnet 32 to drive the impeller 30 to rotate for the purpose of dissipation of heat.

Figure 4:
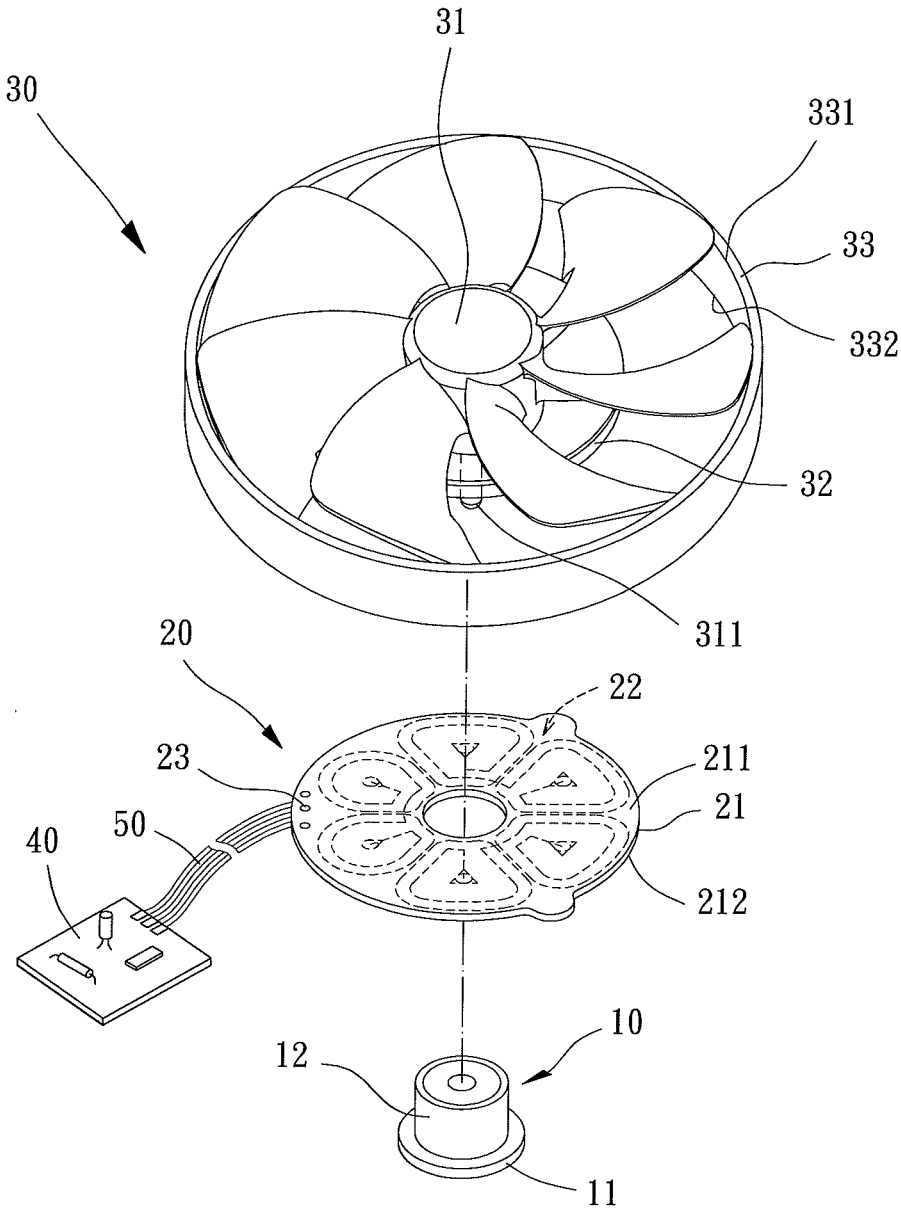
FIG. 4 shows an exploded, perspective view of a heat-dissipating fan of a first embodiment according to the preferred teachings of the present invention.
Figure 5:
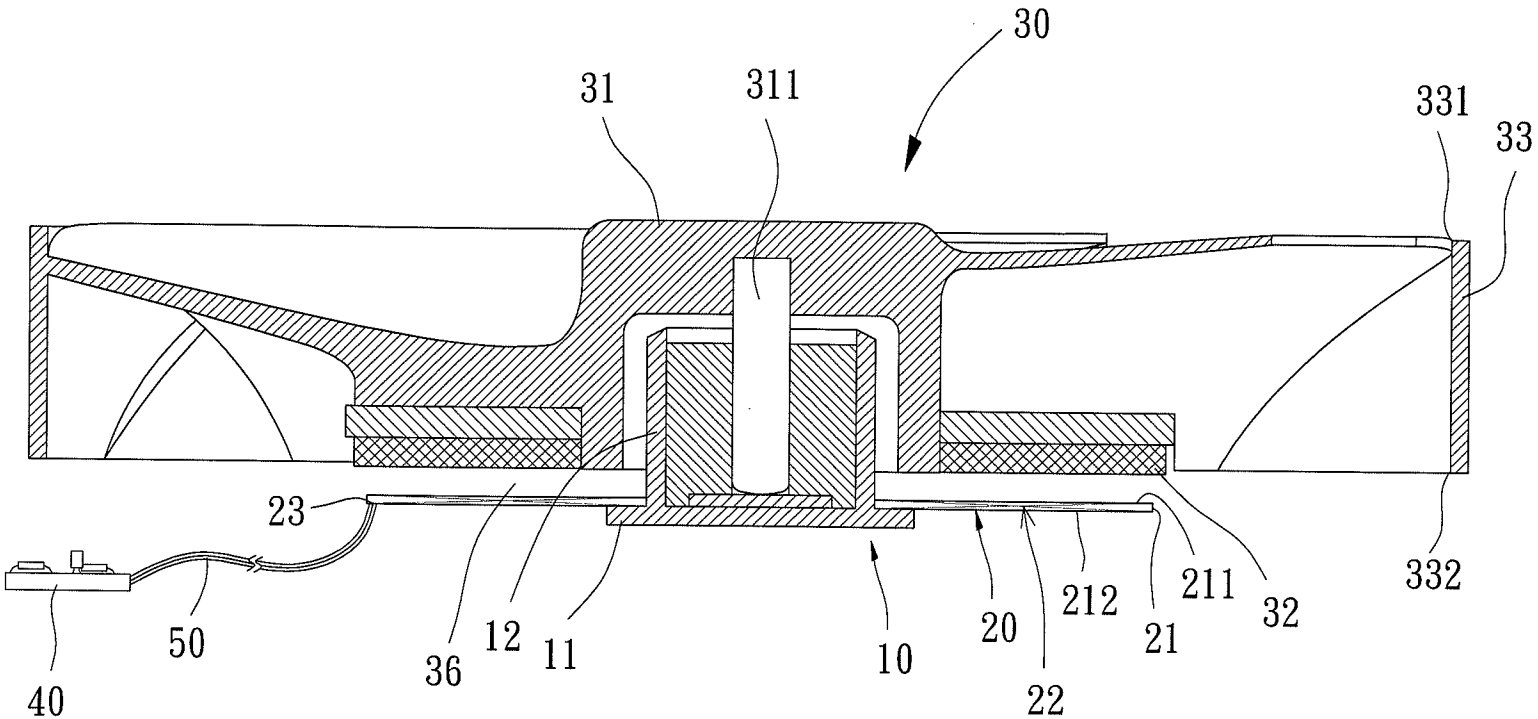
FIG. 5 shows a cross sectional view of the heat-dissipating fan of FIG. 4.

In the preferred form shown in FIGS. 4 and 5, the impeller 30 further includes an annular wall 33 formed around the hub 31. An air inlet 331 and an air outlet 332 are formed between the annular wall 33 and the hub 31. Thus, when the impeller 30 rotates, air currents are drawn in via the air inlet 331 and exit the impeller 30 via the air outlet 332 to a desired location, guiding the direction of the air currents and enhancing the overall air driving effect.

Figure 6:
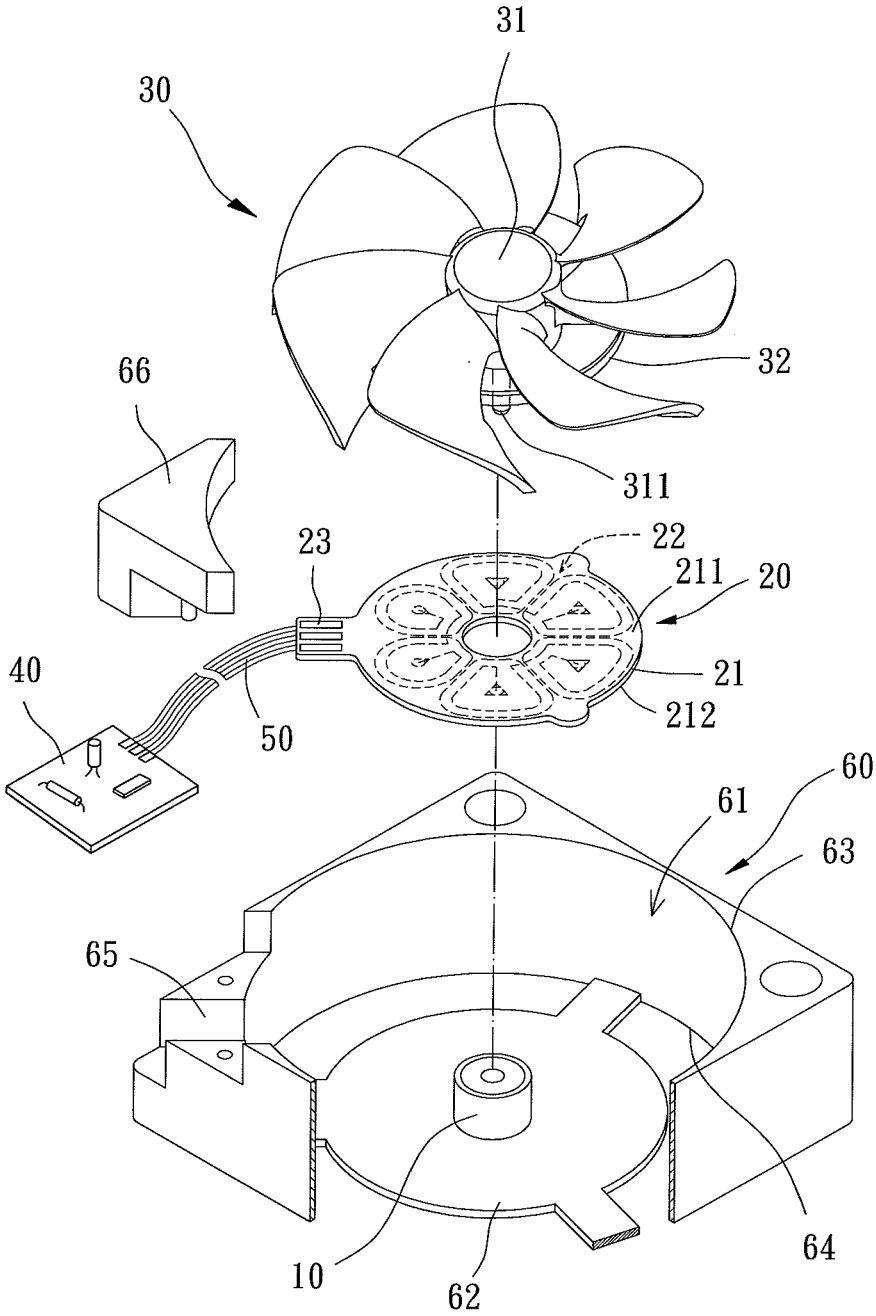
FIG. 6 shows an exploded, perspective view of a heat-dissipating fan of a second embodiment according to the preferred teachings of the present invention.
Figure 7:
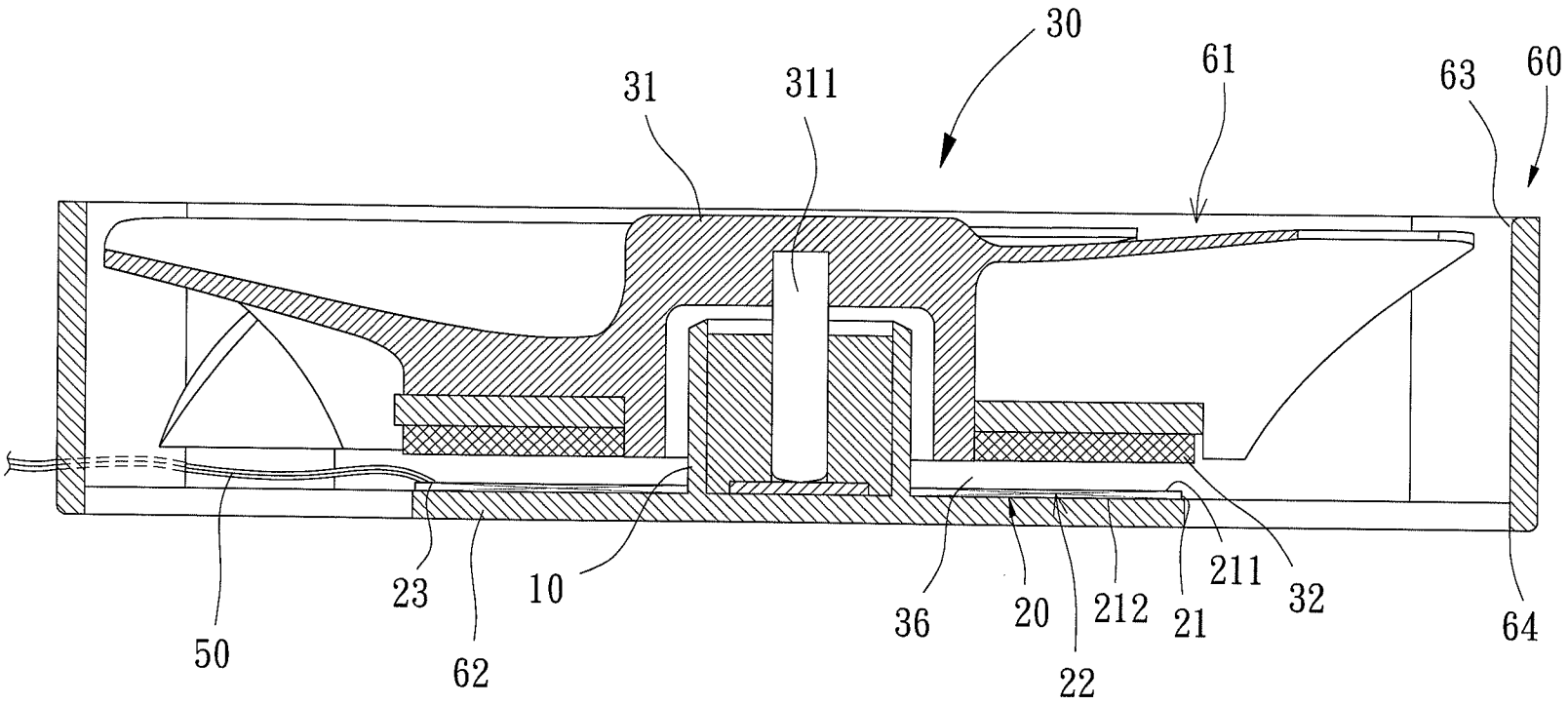
FIG. 7 shows a cross sectional view of the heat-dissipating fan of FIG. 6.

In the preferred form shown in FIGS. 6 and 7, the shaft seat 10 is coupled to a housing 60 having a compartment 61. A mounting portion 62 is provided in the compartment 61, and the shaft seat 10 is coupled to the mounting portion 62. The housing 60 further includes an air inlet 63 and an air outlet 64. The air inlet 63 and the air outlet 64 are in communication with the compartment 61. The housing 60 is of a type for an axial flow fan. However, the housing 60 can be of a type for a blower fan. By such an arrangement, the heat-dissipating fan according to the preferred teachings of the present invention can be conveniently mounted in any electronic device or equipment or on an object requiring dissipation of heat, enhancing utility. Furthermore, the housing 60 can guide the direction of the air currents and enhance the overall air driving effect. Furthermore, the housing 60 includes a slot 65 in communication with the compartment 61. A positioning member 66 is mounted in the slot 65. After the end of the connection wire 50 is electrically connected to the connection port 23 of the base portion 21, the other end of the connection wire 50 is extended through the slot 65 to outside of the housing 60 for connection with the drive circuit 40. The positioning member 66 engaged in the slot 65 presses against and, thus, positions the connection wire 50, avoiding disengagement of the connection wire 50 resulting from pulling the connection wire 50.

Figure 8:
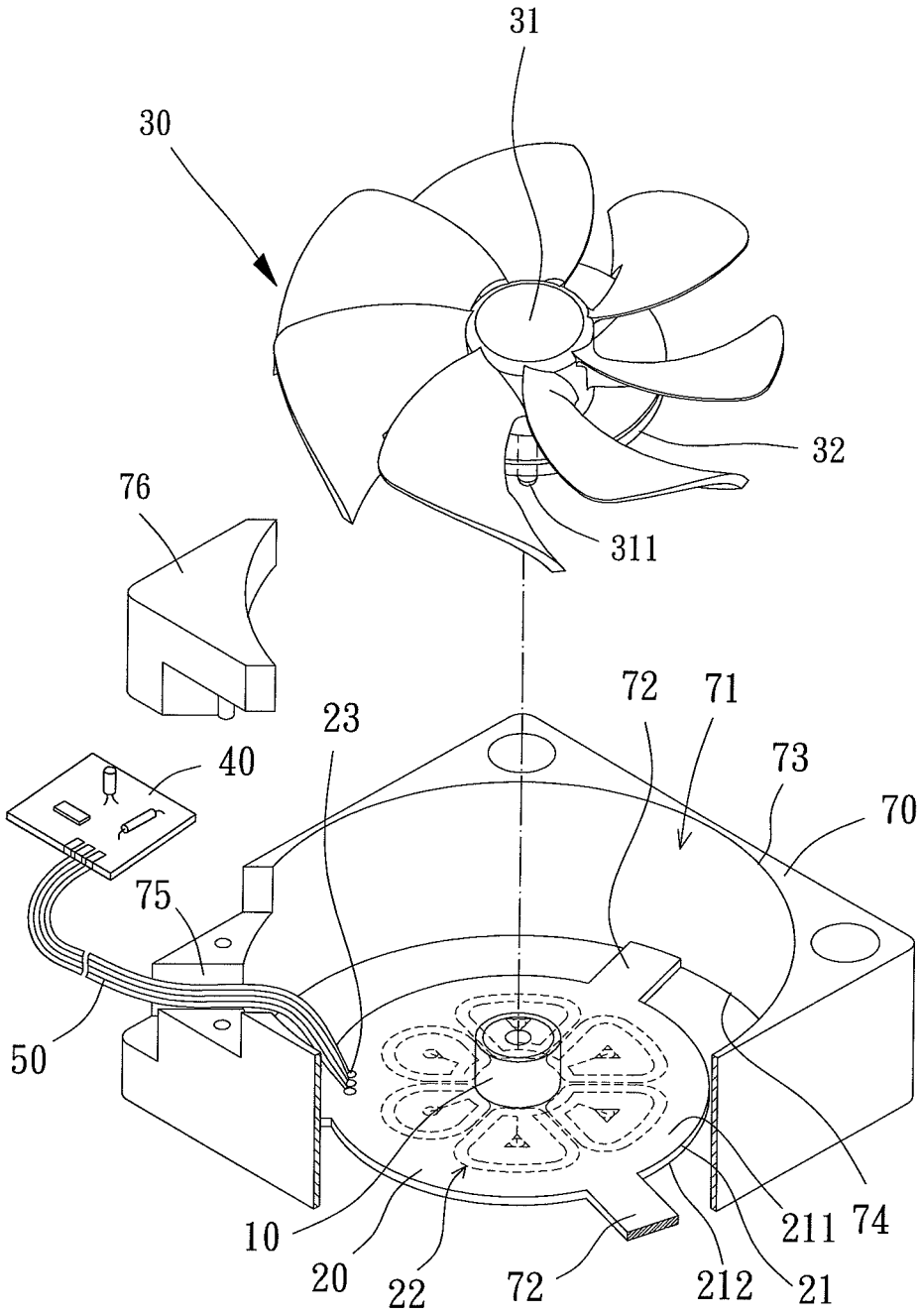
FIG. 8 shows an exploded, perspective view of a heat-dissipating fan of a third embodiment according to the preferred teachings of the present invention.
Figure 9:
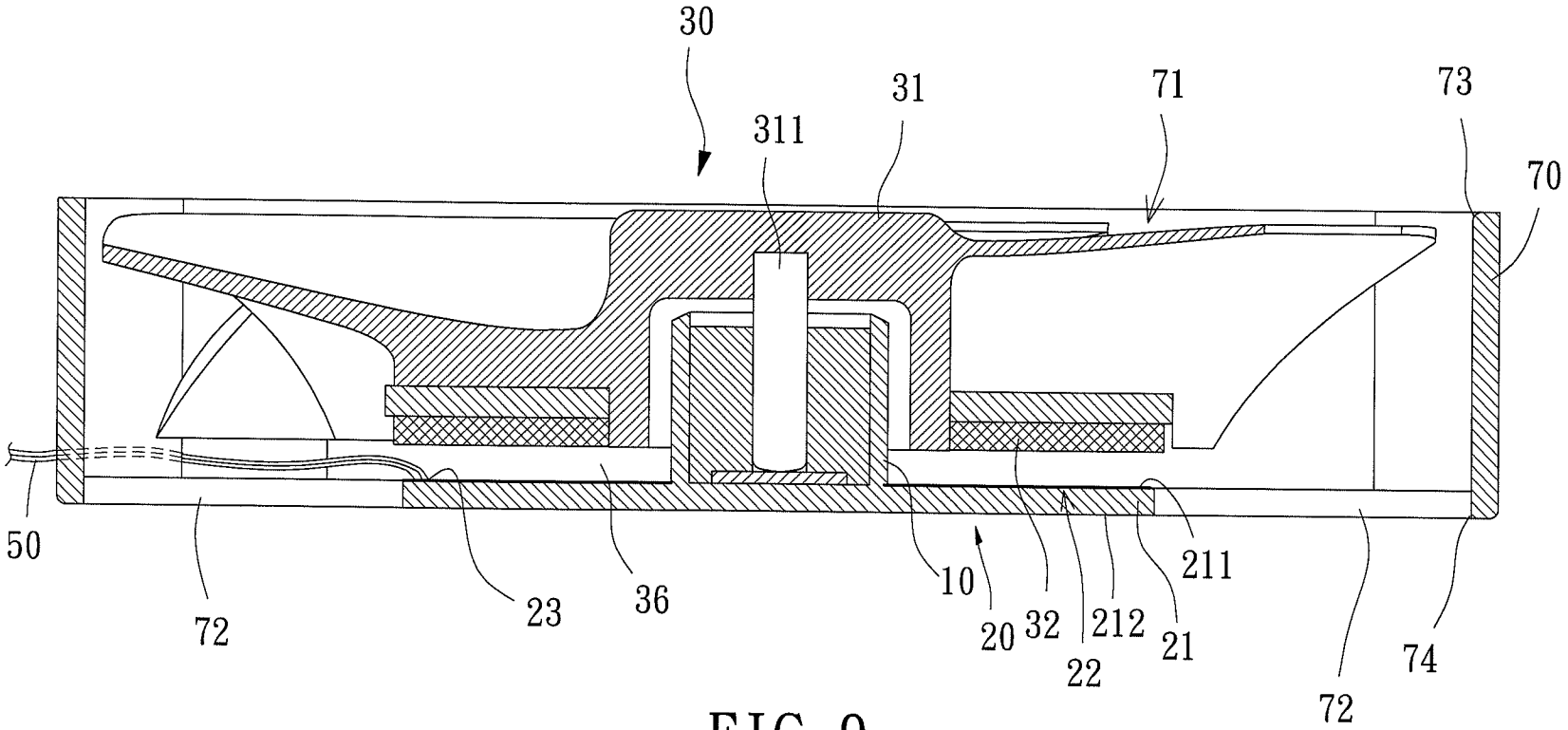
FIG. 9 shows a cross sectional view of the heat-dissipating fan of FIG. 8.

In the preferred forms shown in FIGS. 8 and 9, the coil base 20 is coupled to a housing 70. It can be appreciated that the coil base 20 can be detachably coupled to the housing 70 or integrally formed with the housing 70 as a single continuous monolithic member. The housing 70 includes a compartment 71 in which the coil base 20 is received. The coil base 20 is interconnected to a peripheral wall of the compartment 71 by a plurality of connecting members 72 in the form of ribs or static vanes. The housing 70 further includes an air inlet 73 and an air outlet 74 in communication with the compartment 71. By such an arrangement, the coil base 20 can replace the mounting portion 62 of FIGS. 5 and 6. The axial height of the heat-dissipating fan according to the preferred teachings of the present invention can be reduced, and the structure can be simplified. Furthermore, the housing 70 includes a slot 75 in communication with the compartment 71. A positioning member 76 is mounted in the slot 75. After the end of the connection wire 50 is electrically connected to the connection port 23 of the base portion 21, the other end of the connection wire 50 is extended through the slot 75 to an outside of the housing 70 for connection with the drive circuit 40. The positioning member 76 engaged in the slot 75 presses against and, thus, positions the connection wire 50, avoiding disengagement of the connection wire 50 by pulling the connection wire 50.

Figure 10:
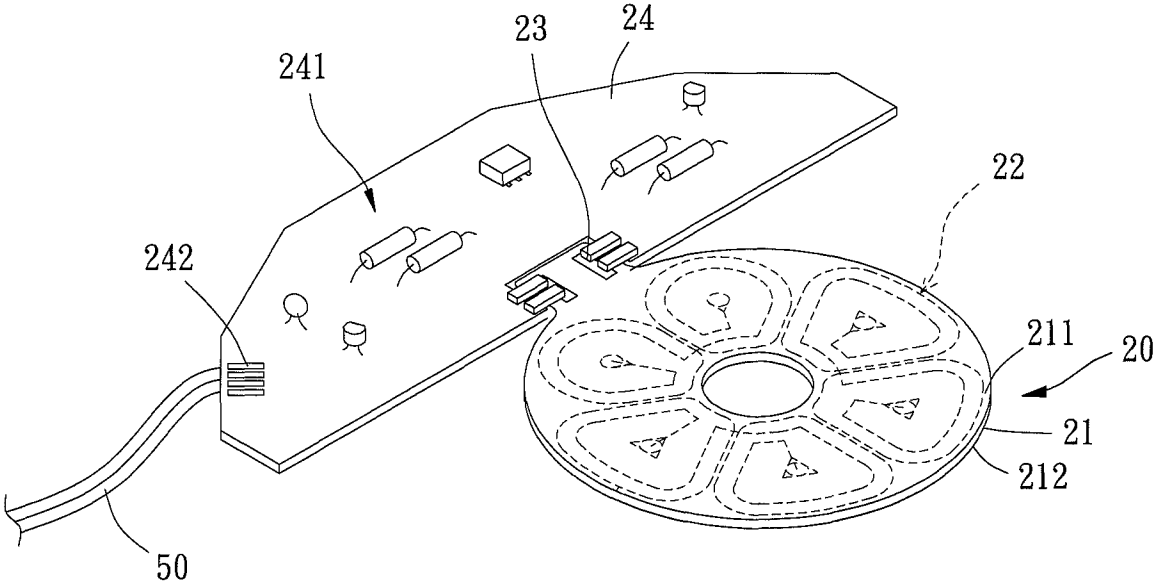
FIG. 10 shows a perspective view of a coil base and a drive circuit board of a heat-dissipating fan according to the preferred teachings of the present invention.

In the preferred form shown in FIG. 10, the connection port 23 is electrically connected to a drive circuit board 24 having a drive circuit 241 and a plurality of electrical connections 242. The drive circuit 241 includes a plurality of electrical elements and is electrically connected to the electrical connections 242 electrically connected to an end of the connection wire 50. The other end of the connection wire 50 is electrically connected to an external power source for supplying electric current to the drive circuit board 24, so that the drive circuit board 241 can activate the coil unit 22. By such an arrangement, the coil base 20 does not have to include the electric elements on the circuit board 24, effectively reducing the axial height of the coil base 20.

Since the drive circuits 40, 241 are not formed on the faces of the coil base 20, the coil base 20 and either of the drive circuits 40, 241 can be separated from each other but electrically connected via the connection wire 50. This allows the drive circuits 40, 241 to be located outside of the air gap 36 between the permanent magnet 32 and the coil unit 22. Specifically, the coil base 20 does not have to include the electric elements on the drive circuits 40, 241, effectively reducing the axial height of the coil base 20, as mentioned above. Either of the drive circuits 40, 241 will not be located between the shaft seat 10, the coil base 20, and the impeller 30 along the axis. The overall axial height and the volume of the heat-dissipating fan according to the preferred teachings of the present invention can be effectively reduced while having a simplified structure and allowing easy assembly.

Furthermore, since the coil unit 22 is on a side of the outer layer 211 of the base portion 21 (preferably between the outer layer 211 and the bottom layer 212), the coil unit 22 can be integrated into an interior of the coil base 20 without protruding out of the faces of the coil base 20. Thus, no coils are located between the permanent magnet 32 and the outer layer 211 of the base portion 21. The height of the coil base 20 along the axis is not significantly increased, although the coil unit 22 is integrated into the coil base 20. The overall axial height of the heat-dissipating fan according to the preferred teachings of the present invention along the axis can, thus, be further reduced. Thus, the heat-dissipating fan formed by the shaft seat 10, the coil base 20, and the impeller 30 according to the preferred teachings of the present invention meets the design trend of compactness and miniaturization.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A heat-dissipating fan comprising, in combination:

a shaft seat;

a coil base coupled to the shaft seat, with the coil base including a base portion and a coil unit coupled to the base portion, with the base portion including a connection port electrically connected to the coil unit, with the base portion having opposite first and second faces spaced along an axis, with the coil base further including an outer layer and a bottom layer, with the outer layer provided on the first face of the base portion as an electrically insulating layer, with the bottom layer provided on the second face of the base portion as an other electrically insulating layer, with the coil unit formed by layout and intermediate the first and second faces, with the coil unit integrated into an interior of the base portion;

an impeller including a hub and a permanent magnet, with a shaft coupled to the hub and rotatably coupled to the shaft seat about the axis, with the permanent magnet coupled to the hub and aligned with the coil unit, with an air gap formed axially between the permanent magnet and the coil unit; and a housing including a plurality of sidewalls forming a compartment and a slot in communication with the compartment, with a mounting portion provided in the compartment, with the shaft seat coupled to the mounting portion, with the housing including an air inlet and an air outlet, and with the air inlet and the air outlet in communication with the compartment, with the connection port of the coil base electrically connected to a drive circuit board, with the drive circuit board including a drive circuit and a plurality of electrical connections electrically connected to the drive circuit, with the drive circuit board located outside of the compartment of the housing and the air gap, with each of the plurality of sidewalls having a radial thickness between an inner periphery and an outer periphery thereof, with said radial thickness being greatest at positions where adjacent sidewalls connect to each other, with the slot radially extending from the inner periphery to the outer periphery at one of the positions where adjacent sidewalls connect to each other, and with the slot axially extending from a side of the housing adjacent to the air inlet and spaced from a side of the housing adjacent to the air outlet.

2. The heat-dissipating fan as claimed in claim 1, with the shaft seat including a fixed portion and a coupling portion formed on a side of the fixed portion, with the shaft rotatably coupled to the coupling portion.

3. The heat-dissipating fan as claimed in claim 1, with the impeller further including an annular wall formed around the hub, and with an air inlet and an air outlet formed between the annular wall and the hub.

4. The heat-dissipating fan as claimed in claim 1, further comprising, in combination: a positioning member mounted in the slot.

5. A heat-dissipating fan comprising, in combination:

a shaft seat;

a coil base coupled to the shaft seat, with the coil base including a base portion and a coil unit coupled to the base portion, with the base portion including a connection port electrically connected to the coil unit, with the base portion having opposite first and second faces spaced along an axis, with the coil base further including an outer layer and a bottom layer, with the outer layer provided on the first face of the base portion as an electrically insulating layer, with the bottom layer provided on the second face of the base portion as an other electrically insulating layer, with the coil unit formed by layout and intermediate the first and second faces, with the coil unit integrated into an interior of the base portion;

an impeller including a hub and a permanent magnet, with a shaft coupled to the hub and rotatably coupled to the shaft seat about the axis, with the permanent magnet coupled to the hub and aligned with the coil unit, with an air gap formed axially between the permanent magnet and the coil unit; and a housing including a compartment having a peripheral wall and a slot in communication with the compartment, with the base portion mounted in the compartment and interconnected to the peripheral wall of the compartment by a plurality of connecting members, with the housing further including an air inlet and an air outlet, and with the air inlet and the air outlet in communication with the compartment, with the connection port of the coil base electrically connected to a drive circuit board, with the drive circuit board including a drive circuit and a plurality of electrical connections electrically connected to the drive circuit, with the drive circuit board located outside of the compartment of the housing and the air gap, with the peripheral wall further comprising a plurality of sidewalls, with each of the plurality of sidewalls having a radial thickness between an inner periphery and outer periphery thereof, with said radial thickness being greatest at positions where adjacent sidewalls connect to each other, with the slot radially extending from the inner periphery to the outer periphery at one of the positions where adjacent sidewalls connect to each other, and with the slot axially extending from a side of the housing adjacent to the air inlet and spaced from a side of the housing adjacent to the air outlet.

6. The heat-dissipating fan as claimed in claim 5, further comprising, in combination: a positioning member mounted in the slot.

7. A heat-dissipating fan comprising, in combination:

a shaft seat;

a coil base coupled to the shaft seat, with the coil base including a base portion and a coil unit coupled to the base portion, with the base portion including a connection port electrically connected to the coil unit, with the connection port electrically connected to an end of a connection wire, with the base portion having opposite first and second faces spaced along an axis, with the coil base further including an outer layer and a bottom layer, with the outer layer provided on the first face of the base portion as an electrically insulating layer, with the bottom layer provided on the second face of the base portion as an other electrically insulating layer, with the coil unit formed by layout and intermediate the first and second faces, with the coil unit integrated into an interior of the base portion;

an impeller including a hub and a permanent magnet, with a shaft coupled to the hub and rotatably coupled to the shaft seat about the axis, with the permanent magnet coupled to the hub and aligned with the coil unit, with an air gap formed axially between the permanent magnet and the coil unit;

a housing including a plurality of sidewalls forming a compartment and a slot in communication with the compartment, with a mounting portion provided in the compartment, with the shaft seat coupled to the mounting portion, with the housing including an air inlet and an air outlet, with the air inlet and the air outlet in communication with the compartment, with each of the plurality of sidewalls having a radial thickness between an inner periphery and an outer periphery thereat with said radial thickness being greatest at positions where adjacent sidewalls connect to each other, with the slot radially extending from the inner periphery to the outer periphery at one of the positions where adjacent sidewalls connect to each other, and with the slot axially extending from a side of the housing adjacent to the air inlet and spaced from a side of the housing adjacent to the air outlet; and a drive circuit electrically connected to another end of the connection wire, with the drive circuit outside of the air gap and the compartment of the housing.

8. The heat-dissipating fan as claimed in claim 7, with the shaft seat including a fixed portion and a coupling portion formed on a side of the fixed portion, with the shaft rotatably coupled to the coupling portion.

9. The heat-dissipating fan as claimed in claim 7, further comprising in combination: a positioning member mounted in the slot.

10. A heat-dissipating fan comprising, in combination:

a shaft seat;

a coil base coupled to the shaft seat, with the coil base including a base portion and a coil unit coupled to the base portion, with the base portion including a connection port electrically connected to the coil unit, with the connection port electrically connected to an end of a connection wire, with the base portion having opposite first and second faces spaced along an axis, with the coil base further including an outer layer and a bottom layer, with the outer layer provided on the first face of the base portion as an electrically insulating layer, with the bottom layer provided on the second face of the base portion as an other electrically insulating layer, with the coil unit formed by layout and intermediate the first and second faces, with the coil unit integrated into an interior of the base portion;

an impeller including a hub and a permanent magnet, with a shaft coupled to the hub and rotatably coupled to the shaft seat about the axis, with the permanent magnet coupled to the hub and aligned with the coil unit, with an air gap formed axially between the permanent magnet and the coil unit;

a housing including a compartment having a peripheral wall and a slot in communication with the compartment, with the base portion mounted in the compartment and interconnected to the peripheral wall of the compartment by a plurality of connecting members, with the housing further including an air inlet and an air outlet, and with the air inlet and the air outlet in communication with the compartment, with the peripheral wall further comprising a plurality of sidewalls, with each of the plurality of sidewalls having a radial thickness between an inner periphery and outer periphery thereof, with said radial thickness being greatest at positions where adjacent sidewalls connect to each other, with the slot radially extending from the inner periphery to the outer periphery at one of the positions where adjacent sidewalls connect to each other, and with the slot axially extending from a side of the housing adjacent to the air inlet and spaced from a side of the housing adjacent to the air outlet; and a drive circuit electrically connected to another end of the connection wire, with the drive circuit outside of the air gap and the compartment of the housing.

11. The heat-dissipating fan as claimed in claim 10, further comprising in combination: a positioning member mounted in the slot.

* * * * *